US008896213B1

(12) United States Patent
Xiong et al.

(10) Patent No.: US 8,896,213 B1
(45) Date of Patent: Nov. 25, 2014

(54) ADAPTIVE LAMP WARM UP CONTROL FOR DIMMING BALLAST BASED ON LAMP IMPEDANCE SENSING

(75) Inventors: Wei Xiong, Madison, AL (US); John J. Dernovsek, Madison, AL (US); Candice Ungacta, Huntsville, AL (US); Danny Pugh, Harvest, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 137 days.

(21) Appl. No.: 13/595,564

(22) Filed: Aug. 27, 2012

Related U.S. Application Data

(60) Provisional application No. 61/529,114, filed on Aug. 30, 2011.

(51) Int. Cl.
*H05B 37/02* (2006.01)

(52) U.S. Cl.
USPC ..... 315/116; 315/121; 315/307

(58) Field of Classification Search
USPC ..... 315/116, 121, 291, 307, 326
See application file for complete search history.

(56) References Cited

U.S. PATENT DOCUMENTS

| | | | | |
|---|---|---|---|---|
| 6,870,326 | B1 * | 3/2005 | Stevens | 315/224 |
| 7,688,006 | B2 * | 3/2010 | Foo | 315/307 |
| 8,008,873 | B2 * | 8/2011 | Bakre et al. | 315/308 |
| 2008/0211417 | A1 * | 9/2008 | Foo | 315/207 |
| 2010/0301759 | A1 * | 12/2010 | Bakre et al. | 315/185 R |

* cited by examiner

*Primary Examiner* — Daniel D Chang
(74) *Attorney, Agent, or Firm* — Waddey Patterson; Mark J. Patterson; Mark A. Pitchford

(57) ABSTRACT

A ballast is designed to adaptively warm-up one or more lamps driven by the ballast when the lamps are dimmed to a selected dimming level and lamp impedance instability results. The ballast can therefore maintain a stable light output in low ambient temperature conditions that normally cause lamp impedance instability and visible flickering of the lamp. The ballast uses lamp impedance sensing circuit to sense lamp instability and adaptively warms up the lamp whenever the ballast detects lamp instability by increasing the current provided to the lamp (i.e., current through the lamp) for a predetermined period of time.

18 Claims, 7 Drawing Sheets

ADAPTIVE LAMP WARM UP CONTROL FOR DIMMING BALLAST BASED ON LAMP IMPEDANCE SENSING

CROSS-REFERENCES TO RELATED APPLICATIONS

This application claims benefit of the following patent application which is hereby incorporated by reference: U.S. Provisional Patent Application No. 61/529,114 filed Aug. 30, 2011, entitled "Adaptive Lamp Warm Up Control for Dimming Ballast Based on Lamp Impedance Sensing."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronic dimming ballasts for gas discharge lamps. More particularly, the present invention pertains to methods and circuits used in electronic ballasts for maintaining stable lamp operation when dimming the lamp.

Dimming ballasts control light output from a light fixture while saving energy. An exemplary prior art series resonant inverter ballast for a fluorescent lamp is shown in FIG. 5. In FIG. 5, a typical single lamp dimming ballast topology is based on a series resonant inverter including a resonant inductor L1 and a resonant capacitor C1 that form a resonant tank. A first alternating current (AC) source VAC1 represents the equivalent output of a half-bridge inverter configured to drive the resonant tank. The first AC source VAC1 provides a frequency controlled fixed voltage input for the resonant tank. By changing the frequency of the first AC source VAC1, the current provided by the resonant tank to the lamp L2 can be adjusted.

A second AC source VAC2 is a fixed voltage, variable frequency AC source used to drive a filament heating circuit. A filament capacitor C3 and a filament heating transformer primary winding T1 form a filament heating resonant tank that changes the power provided to the filaments of the lamp is response to variation in the frequency of the second AC source VAC2. The filament heating transformer has a first secondary winding T2 and a second secondary winding T3. The first secondary winding T2 and the second secondary winding T3 drive a first lamp filament RF1 and a second lamp filament RF2 respectively. A microcontroller 504 receives and decodes a dimming control signal and adjusts the frequency of the first AC source VAC1 and the second AC source VAC2 to adjust the lamp current and the filament heating current.

Dimming ballasts, however, generally cannot provide a stable current to a lamp when the ambient temperature is low (e.g., less than 10 degrees C.). The primary reason for instability of the lamp current while the ballast is reducing current to correspond to a selected dimming level is that the impedance of the fluorescent lamp changes suddenly at low ambient temperatures when dimming to a selected dimming level. Because this unstable lamp impedance is unpredictable, it is difficult to design a control loop to stabilize the lamp current and light output. FIGS. 1-4 graphically show a series of T528 W lamp currents when dimming the lamp from 72 mA to 20 mA at 5 degrees C. ambient temperature. As shown in FIG. 1, lamp current is stable when lamp current is around 72 mA. Referring to FIG. 2 which shows lamp current at 56 mA and FIG. 3 which shows lamp current at 36 mA, the lamp current starts to fluctuate when the lamp current is reduced to between 56 mA and 20 mA in a 5 degrees C. ambient temperature environment. The lamp current stabilizes when it gets down to around 20 mA as shown in FIG. 4.

The unstable lamp impedance and current can cause visible lamp flickering when the ballast is dimming the lamp to a selected light output level (i.e., selected dimming level). Because lamp impedance is very difficult to predict under low current and low temperature conditions, lamp flickering cannot be easily eliminated with conventional lamp current control loop designs. For this reason, dimming ballasts available today generally list a minimum ambient operating temperature requirement for normal lamp operation of, for example, 0 degrees C. for supplying current to a T8 type lamp and 10 degrees C. for supplying current to a T5 type lamp.

BRIEF SUMMARY OF THE INVENTION

The circuit and method of the present invention improve ballast stable current operation capability at lower ambient temperatures and eliminate lamp flickering. In one embodiment, lamp impedance (Z) sensing is used to detect lamp instability (i.e., unstable lamp current). In one embodiment, a ballast adaptively warms a lamp when the ballast senses lamp instability while adjusting lamp current down to a selected dimming level.

In one aspect of the present invention, an electronic ballast includes an inverter, a resonant tank, an impedance sensing circuit, and a controller. The ballast is operable to provide stable current from a power source to a lamp connected between a first output terminal and a second ballast output terminal while decreasing light output of the lamp to a selected dimming level. The inverter is operable to receive power from the power source and provide an alternating current (AC) signal. The resonant tank is connected to the inverter, and a resonant tank is operable to receive AC signal from the inverter and provide an output signal across the first and second ballast output terminals. The impedance sensing circuit includes a direct current (DC) power supply, a first resistor, a second resistor, and a third resistor. The DC power supplies operable to provide a DC voltage referenced to a ballast ground. The first resistor is connected between the DC power supply and the first ballast output terminal. The second resistor has a first terminal connected to the first ballast output terminal. The second terminal of the second resistor provides an impedance signal as a DC voltage representative of an lamp impedance. The third resistor is connected between the ballast ground and the second terminal of the second resistor. The controller is connected to the inverter and the second terminal of the second resistor. The controller is operable to sense the lamp impedance via the impedance signal provided at the second terminal of the second resistor, and calculate a change in the lamp impedance over time. The controller is further operable to determine whether the lamp impedance is unstable by determining whether the change in the lamp impedance over time exceeds a predetermined threshold. When the lamp impedance is unstable, the controller is operable to increase the current provided to the lamp for a predetermined period of time by adjusting a frequency of AC signal provided by the inverter.

In another aspect, a light fixture operable to provide light from a power source includes a lamp, a ballast, and a housing. The lamp is operable to provide light in response to receiving a current. The housing is connected to the lamp and to the ballast. The ballast includes an inverter, a resonant tank, an impedance sensing circuit, and a controller. The ballast has a first ballast output terminal and a second ballast output terminal. The lamp is connected between the first output terminal and the second ballast output terminal. The ballast is operable to provide stable current from the power source to the lamp while decreasing light output of the lamp to a selected dimming level. The inverter is operable to receive power from the power source and provide an alternating current (AC) signal. The resonant tank is connected to the inverter and is effective to receive an AC signal from the inverter and provide an output signal across the first and second ballast output terminals. The impedance sensing circuit includes a direct current (DC) power supply, a first resistor, a second resistor, and a third resistor. The DC power supplies operable to provide a DC voltage referenced to a ballast ground. The first resistor is connected between the DC power supply and the first ballast output terminal. The second resistor has a first terminal and a second terminal. The first terminal of the second resistor is connected to the first ballast output terminal. The second terminal of the second resistor provides an impedance signal as a DC voltage representative of an lamp impedance. The third resistor is connected between the ballast ground and the second terminal of the second resistor. The controller is connected to the inverter and the second terminal of the second resistor. The controller is operable to sense the lamp impedance via the impedance signal provided at the second terminal of the second resistor, and calculate a change in the lamp impedance over time. The controller is further operable to determine whether the lamp impedance is unstable by determining whether the change in the lamp impedance over time exceeds a predetermined threshold. When the lamp impedance is unstable, the controller is operable to increase the current provided to the lamp for a predetermined period of time by adjusting a frequency of AC signal provided by the inverter.

In another aspect, a method of providing stable current to a lamp from a power source via a ballast while decreasing lamp light output to a selected dimming level includes sensing an lamp impedance via an impedance sensing circuit of the ballast. A ballast controller then calculates a change in the lamp impedance over time. The controller determines whether the lamp impedance is unstable by determining whether the change in the lamp impedance over time exceeds a predetermined threshold. The controller adjusts a frequency of an AC signal provided by the ballast inverter to increase the current provided to the lamp by the inverter for a predetermined period of time when the lamp impedance is determined to be unstable.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As used herein, "ballast" refers to any circuit for providing power from a power source to a light source. Additionally, "light source" refers to one or more light emitting devices such as fluorescent lamps, high intensity discharge lamps, incandescent bulbs, and solid state light-emitting elements such as LEDs, organic light emitting diodes, and plasmaloids. In one embodiment, the lamp described herein is a fluorescent lamp.

In one embodiment, a ballast is designed to adaptively warm-up one or more lamps driven by the ballast when the lamps are dimmed to a selected dimming level so that a stable light output can be maintained in low ambient temperature conditions that normally cause lamp impedance instability. The ballast uses lamp impedance (Z) sensing to detect lamp instability and adaptively warms up the lamp whenever the ballast detects lamp instability.

Figure 1:
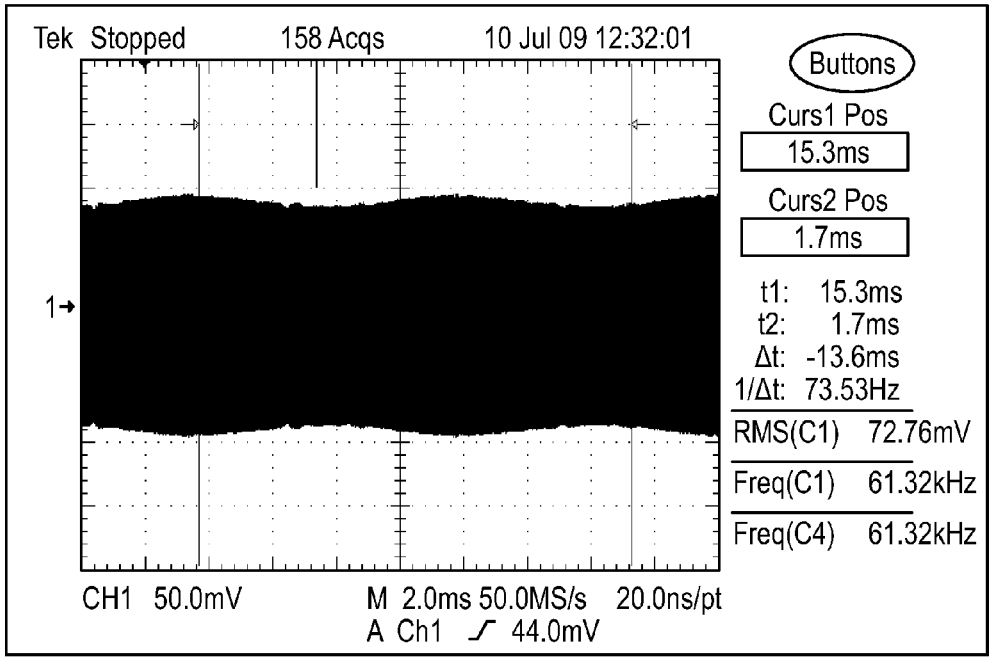
FIG. 1 is a screen capture image of an oscilloscope trace showing T528 W lamp current at 72 mA and an ambient temperature of 5 degrees C.
Figure 2:
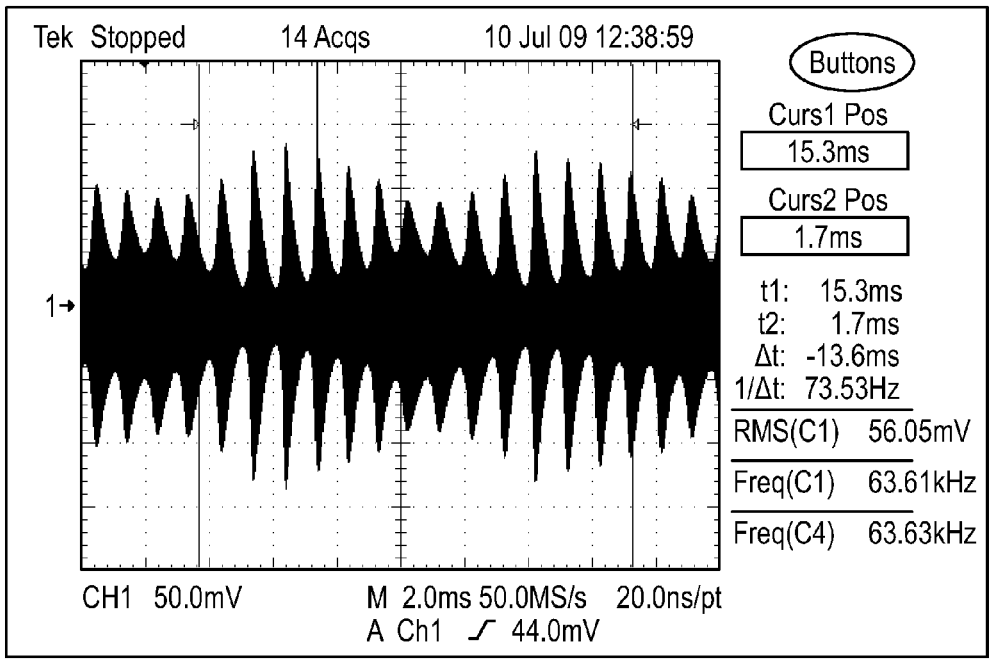
FIG. 2 is a screen capture image of an oscilloscope trace showing T528 W lamp current at 56 mA and an ambient temperature of 5 degrees C.
Figure 3:
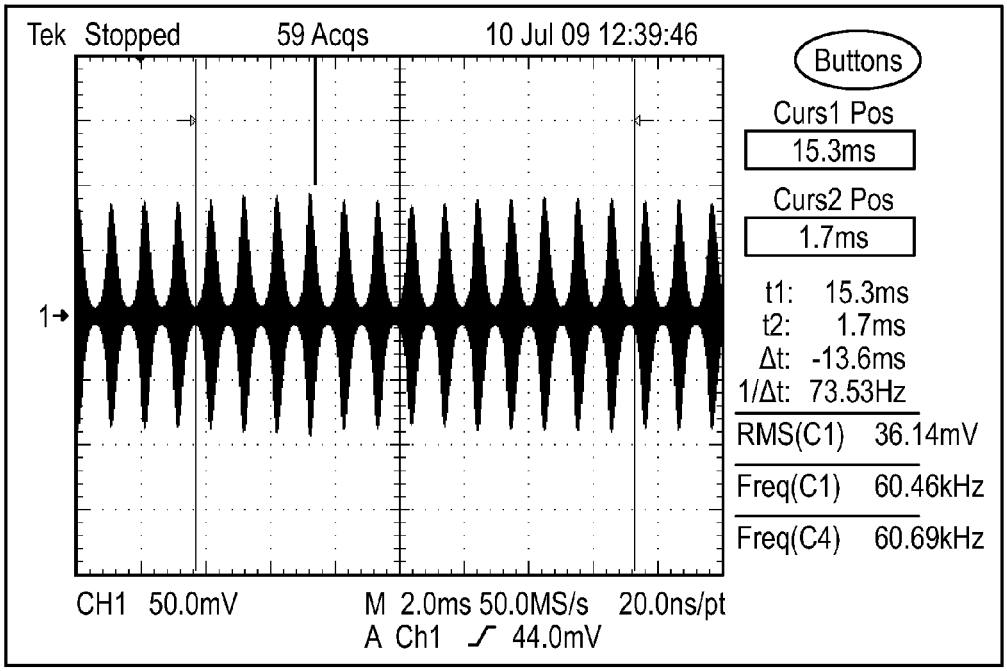
FIG. 3 is a screen capture image of an oscilloscope trace showing T528 W lamp current at 36 mA and an ambient temperature of 5 degrees C.
Figure 4:
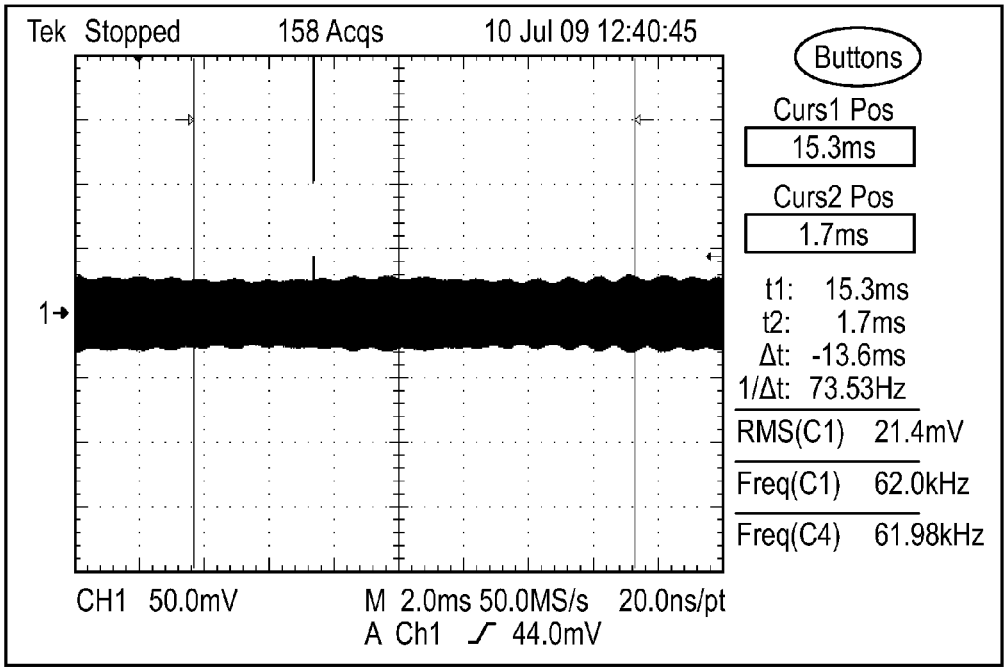
FIG. 4 is a screen capture image of an oscilloscope trace showing T528 W lamp current at 21 mA and an ambient temperature of 5 degrees C.
Figure 5:
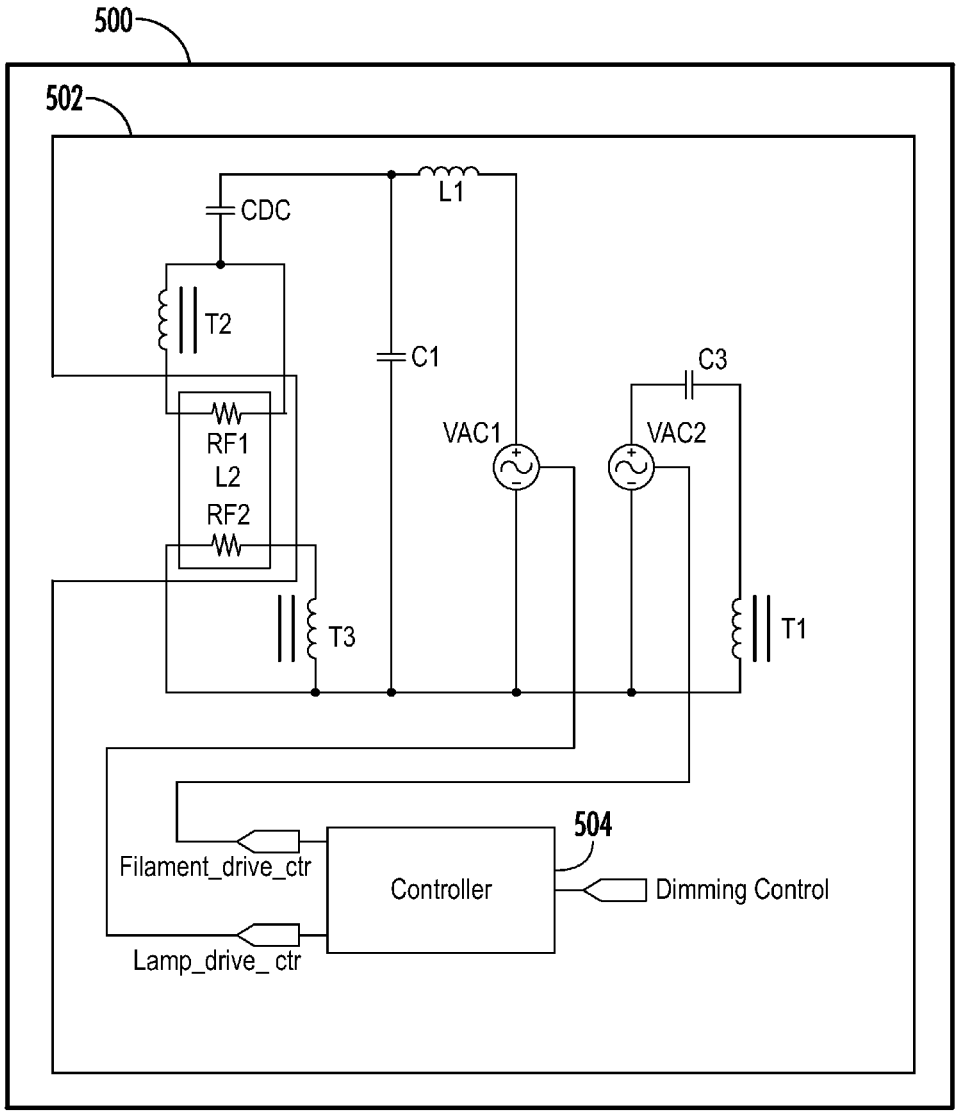
FIG. 5 (PRIOR ART)
FIG. 5 is a partial schematic and block diagram of a prior art light fixture including a dimming ballast having a topology based on a series resonant inverter.
Figure 6:
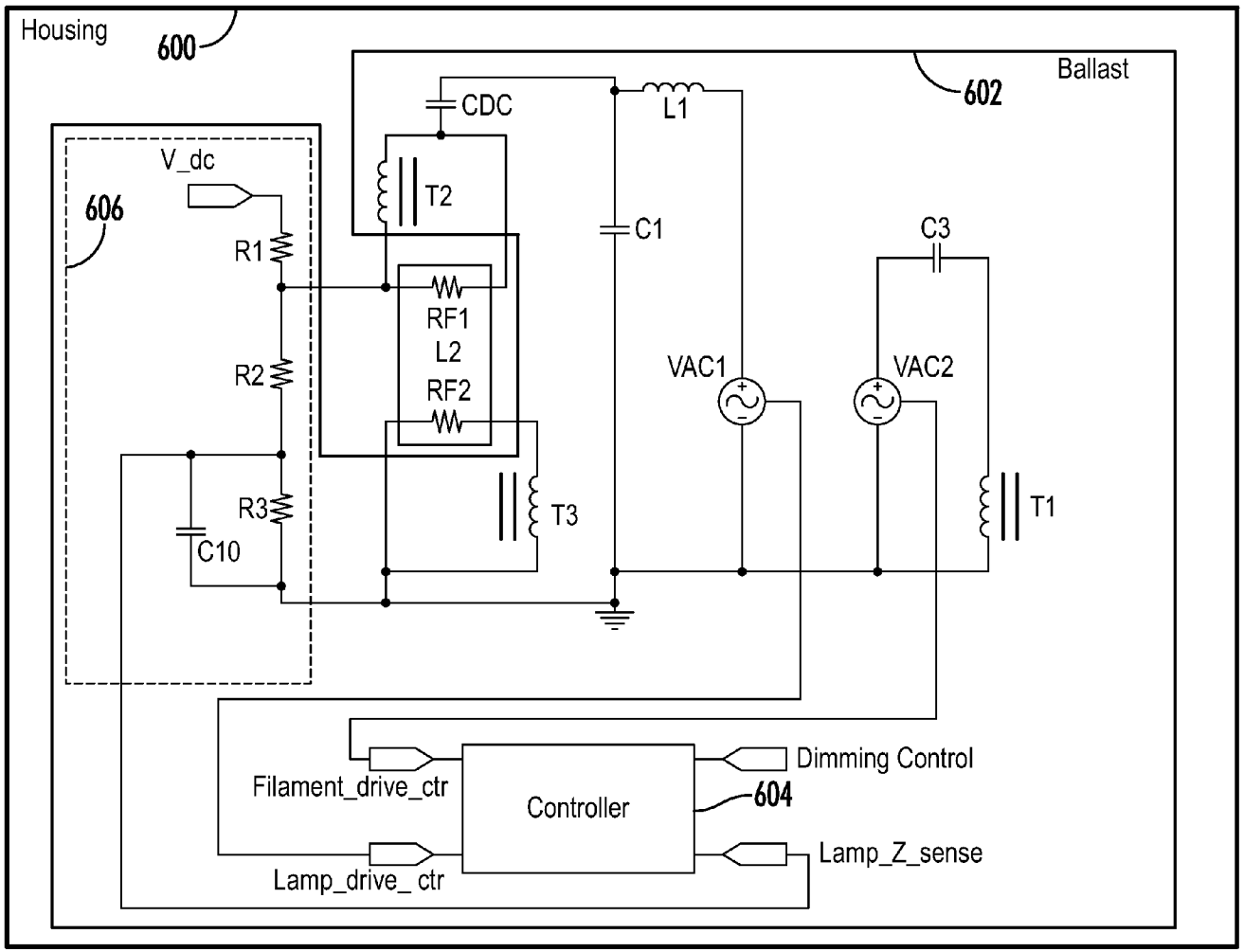
FIG. 6 is a partial schematic and block diagram of a light fixture including a dimming ballast having a topology based on a series resonant inverter and an impedance sensing circuit in accordance with an embodiment of the present invention.

In FIG. 6, a lamp impedance sensing circuit 606 is added to the basic prior art ballast topology shown in FIG. 5. The lamp impedance sensing circuit 606 senses the lamp impedance and provides a lamp impedance sensing voltage to enable detection of lamp instability. A direct current (DC) voltage V_dc (e.g., a DC voltage supplied by a voltage regulator in the ballast) is used to offset a DC circuit that includes first resistor R1, second resistor R2, third resistor R3, smoothing capacitor C10, and lamp L2. The second resistor R2 and the third resistor R3 are selected such that the voltage across the smoothing capacitor C10 is dominated by lamp (L2) impedance (see Equations 1 and 2). A voltage across the smoothing capacitor C10 is a DC voltage indicative of the lamp impedance (Z). The voltage across the smoothing capacitor C10 may also be referred to as an impedance signal (Lamp_Z_sense) or lamp impedance sensing voltage output by the impedance sensing circuit 606 to a controller 604 of the ballast.

$$\text{Lamp_Z_sense} = \frac{\dfrac{1}{\dfrac{1}{Z} + \dfrac{1}{R1 + R2}}}{R1 + \dfrac{1}{\dfrac{1}{Z} + \dfrac{1}{R3 + R2}}} \times \text{V_dc} \qquad \text{Equation 1}$$

When the impedance of the second resistor R2 and the third resistor R3 is much greater than lamp impedance (Z), Equation 1 can be simplified to Equation 2 which shows that lamp_Z_sense is dominated by Z.

$$\text{Lamp_Z_sense} = \frac{Z}{R1 + Z} \times \text{V_dc} \qquad \text{Equation 2}$$

According to Equation 2, when the lamp impedance L2 is high or increasing, the Lamp_Z_sense signal is high and increasing. Conversely, when the lamp impedance L2 is low or decreasing, the lamp impedance signal Lamp_Z_sense is low or decreasing.

Generally, the lamp L2 impedance (Z) increases when the lamp L2 is dimmed. The lamp impedance (Z) can have a sudden change when dimming under low temperature conditions, which will result in a sudden change of the impedance (Z) of the lamp L2 and thus the impedance signal Lamp_Z_sense.

Figure 7:
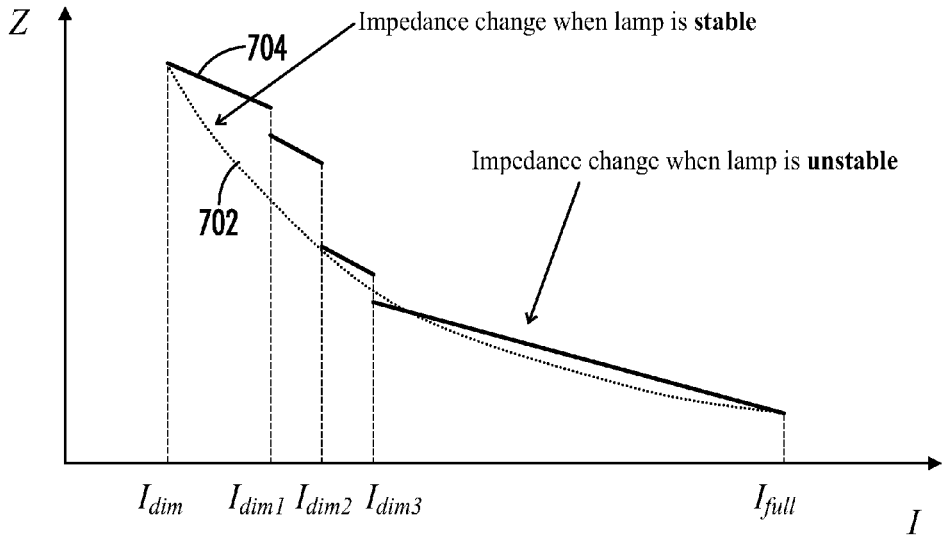
FIG. 7 is a plot of lamp impedance (Z) versus current for stable lamp impedance and unstable lamp impedance.

FIG. 7 shows a first plot 702 of lamp L2 impedance (Z) versus current when operating stably at high ambient temperature (e.g., greater than 10 degrees C.). A second plot 704 shows lamp L2 impedance (Z) versus current when operating at low ambient temperature and the lamp is unstable. When the lamp L2 is warm and operating stably, lamp impedance (Z) changes with lamp current, as shown in a nonlinear, smooth waveform 702 that decreases with increasing current. When the lamp L2 is cold and lamp impedance is unstable, the lamp impedance (Z) is a plot 704 with sudden increases at certain lamp current levels (i.e., dimming levels). As shown in FIG. 7, lamp impedance (Z) increases when decreasing lamp current to a selected dimming level (i.e., lamp current I_dim3, I_dim2, or I_dim1).

Figure 8:
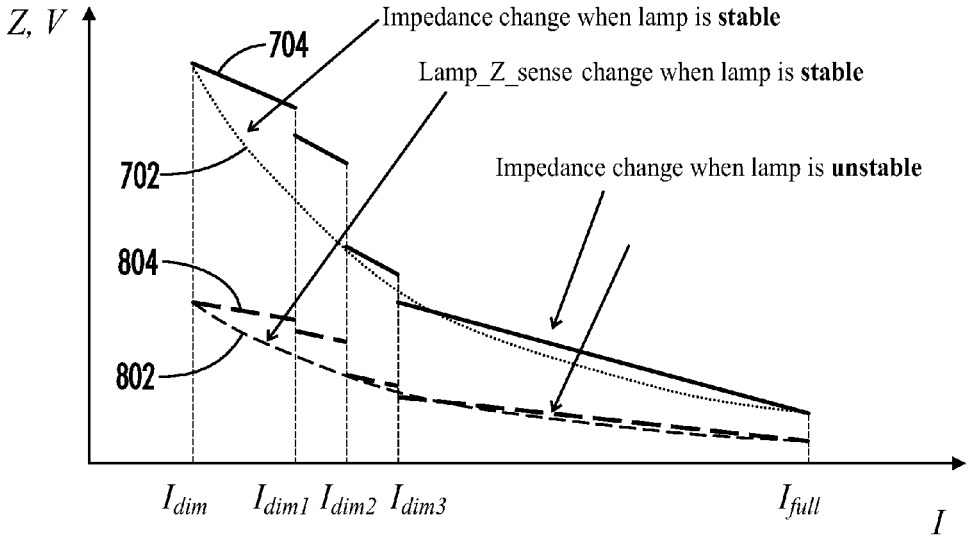
FIG. 8 is a plot of lamp impedance (Z) and lamp impedance sensing voltage output by the impedance sensing circuit of the ballast of FIG. 6 versus current for stable lamp impedance and unstable lamp impedance.

The impedance signal (i.e., Lamp_Z_sense or the voltage across the smoothing capacitor C10) tracks the actual lamp impedance (Z) as shown in FIG. 8. When the lamp L2 is warm and operating stably, a first plot of the impedance signal 802 changes with lamp current in a nonlinear, smooth waveform 802 that decreases with increasing current. When the lamp L2 is cold and lamp impedance is unstable, a second plot 804 of the impedance signal (Lamp_Z_sense) shows sudden increases at certain lamp current levels (i.e., dimming levels). The impedance signal Lamp_Z_sense can have large changes in short time periods (i.e., a large dV/dt) that can be sensed by the controller 604 and used to determine whether the lamp is stable. Whenever the controller 604 senses this dV/dt in excess of a predetermined threshold (i.e., lamp instability) during dimming, the controller 604 can automatically increase the lamp current to a predetermined level (e.g. rated current or rated light output) and maintain the current at that level for a certain time to warm up the lamp L2. After a preset warm up period, the controller 604 can again try to dim the lamp to the selected dimming level as determined from a dimming control signal received at the controller 604 from a dimmer operated by a user to select the dimming level. This cycle continues until the lamp L2 is fully warmed up and able to operate stably at the selected dimming level.

Figure 9:
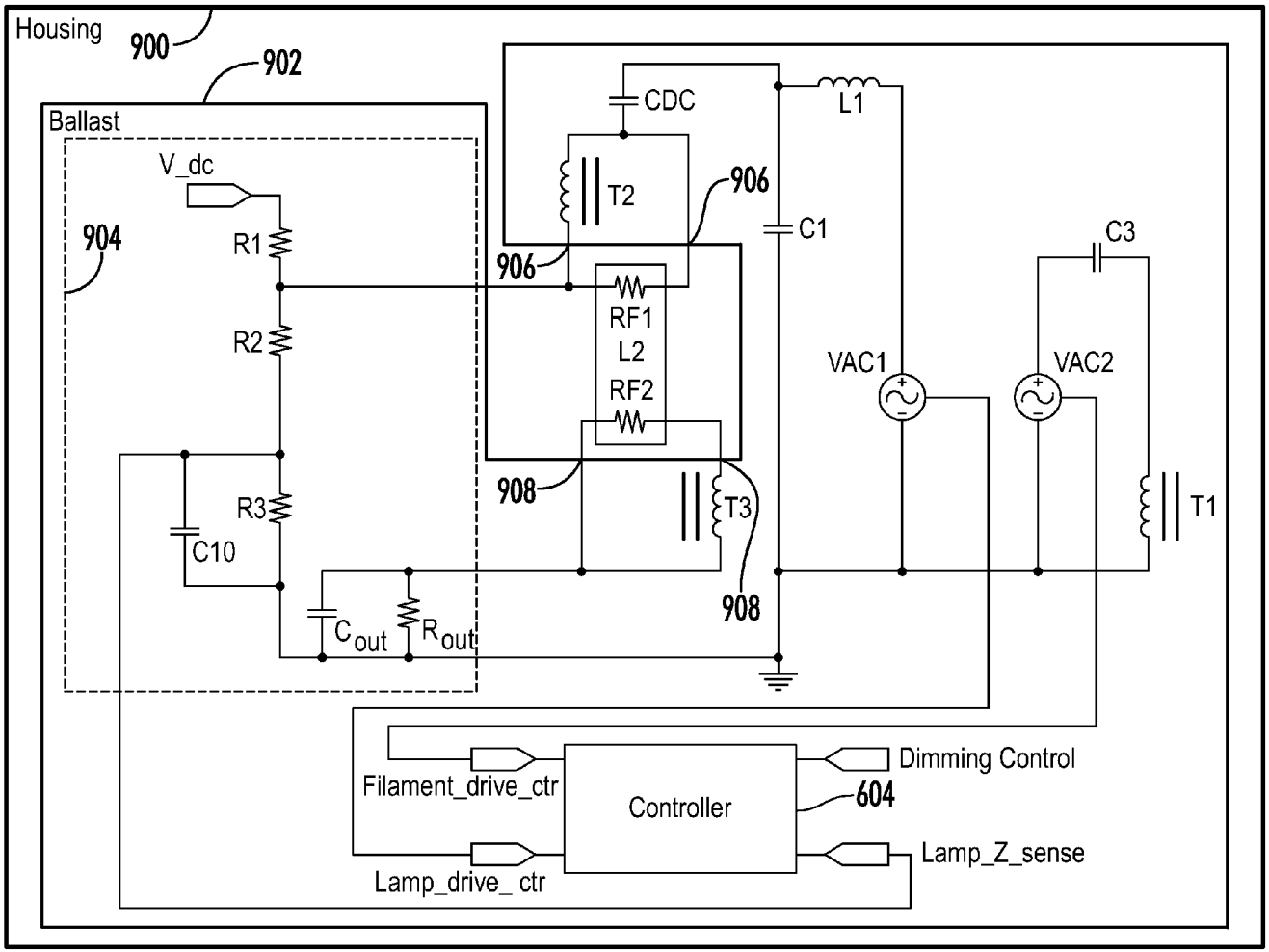
FIG. 9 is a partial schematic and block diagram of a light fixture including a dimming ballast having a topology based on a series resonant inverter and an impedance sensing circuit in accordance with an embodiment of the present invention.

To limit DC current through the lamp L2, the resistance of first resistor R1 has to be set relatively high. Thus, the voltage of the impedance signal Lamp_Z_sense is very low because the lamp impedance L2 is much lower than the impedance of the first resistor R1. This low voltage of the impedance signal Lamp_Z_sense is difficult for the controller 604 to sense with accuracy. Referring to FIG. 9, a ballast 902 includes an improved lamp impedance sensing circuit 904 as compared to the ballast 602 and impedance sensing circuit 606 shown in FIG. 6. An output capacitor $C_{OUT}$ and an output resistor $R_{OUT}$ are added to increase the signal level of the impedance signal Lamp_Z_sense. The output capacitor $C_{OUT}$ is a large capacitor whose AC impedance is very small such that the output capacitor $C_{OUT}$ will not affect any normal circuit operations. The output resistor $R_{OUT}$ is used to increase the Lamp_Z_sense signal level so that it is easier for the controller 604 to sense. When the output resistor $R_{OUT}$ is added to the circuit, Equation 2 becomes Equation 3.

$$\text{Lamp_Z_sense} = \frac{Z + ROUT}{R1 + Z + ROUT} \times \text{V_dc} \qquad \text{Equation 3}$$

Referring again to FIG. 9, a light fixture operable to provide light from a power source is shown. The light fixture includes a housing 900, a ballast 902, and a lamp L2. The lamp L2 provides light in response to receiving a current from the ballast 902. The housing 900 is connected to the ballast 902 and the lamp L2, and in one embodiment, supports and contains the ballast 902 and the lamp L2. The ballast 902 has a first output terminal 906 and a second output terminal 908. The lamp L2 is connected between the first output terminal 906 and the second output terminal 908. The ballast 902 is operable to provide stable current from the power source connected to the light fixture to the lamp L2 while decreasing light output of the lamp L2 to a selected dimming level (i.e., decreasing the current provided to the lamp L2 to a current level corresponding to the selected dimming level). The ballast 902 includes an inverter VAC1, a resonant tank, an impedance sensing circuit 904, and a controller 604.

The inverter VAC1 is operable to receive power from the power source and provide an alternating current (AC) signal. In one embodiment, the inverter VAC1 is a half bridge inverter connected to a DC to DC converter which is powered by rectifier connected to the power source.

The resonant tank is connected to the inverter VAC1. The resonant tank includes the resonant inductor L1 and the resonant capacitor C1. The resonant tank is operable to receive the AC signal from the inverter VAC1 and provide an output signal across the first and second ballast output terminals 902. The resonant inductor L1 has a first terminal and a second terminal. The first terminal of the resonant inductor L1 is connected to an output of the inverter VAC1 to receive the AC signal provided by the inverter VAC1. The resonant capacitor C1 is connected between the second terminal of the resonant inductor L1 and the ballast ground 902. In one embodiment, the resonant tank also includes a DC blocking capacitor CDC connected between the second terminal of the resonant inductor L1 and the first output terminal 906 of the ballast 902.

The impedance sensing circuit 904 includes a direct current (DC) power supply V_dc, a first resistor R1, a second resistor R2, and a third resistor R3. The DC power supply provides a DC voltage V_dc referenced to a ballast ground 902. The first resistor R1 is connected between the DC power supply V_dc and the first output terminal 906 of the ballast 902. The second resistor R2 has a first terminal and a second terminal. The first terminal of the second resistor R2 is connected to the first output terminal 906 of the ballast 902. The second terminal of the second resistor R2 provides an impedance signal that is a DC voltage representative of a lamp impedance L2. The third resistor R3 is connected between the ballast ground 902 and the second terminal of the second resistor R2.

In one embodiment, the impedance sensing circuit 904 further includes an output capacitor $C_{OUT}$ and an output resistor $R_{OUT}$. The output capacitor $C_{OUT}$ is connected between the second output terminal 908 of the ballast 902 and the ballast ground 902. The output resistor $R_{OUT}$ is connected in parallel with the output capacitor $C_{OUT}$. In one embodiment, the impedance sensing circuit 904 also includes a smoothing capacitor C10 connected in parallel with the third resistor R3.

The controller 604 is connected to the inverter VAC1 and the second terminal of the second resistor R2. The controller 604 is also connected to a dimming controller 604 that provides a dimming level selected by a user (i.e., the selected dimming level). The controller 604 senses the lamp impedance L2 via the impedance signal provided at the second terminal of the second resistor R2. The controller 604 calculates a change in the lamp impedance L2 over time (i.e., dV/dt). The controller 604 then determines whether the lamp impedance L2 is unstable by determining whether the change in the lamp impedance (i.e., dV/dt) exceeds a predetermined threshold. When the lamp impedance L2 is determined to be unstable, the controller 604 increases the current provided to the lamp L2 for a predetermined period of time by adjusting a frequency of the AC signal provided by the inverter VAC1.

In one embodiment, the ballast 902 also includes a filament heating circuit operable to heat the filaments (i.e., the first filament RF1 and the second filament RF2) of the lamp L2. The filament heating circuit includes a filament circuit inverter VAC2, a second DC blocking capacitor C3, and a transformer. The transformer has a primary winding T1, a first secondary winding T2, and a second secondary winding T3. The primary winding T1 of the transformer is connected in series with the second DC blocking capacitor C3 between an output of the filament circuit inverter VAC2 and the ballast ground 902. The first secondary winding T2 is connected between the series resonant tank and the first output terminal 906 of the ballast 902. The second secondary winding T3 is connected between the second output terminal 908 of the ballast in the ballast ground 902.

In one embodiment, the power source connected to the light fixture is an AC power source and the ballast 902 includes a rectifier and a DC to DC power converter connected between the power source and the inverter VAC1.

In one embodiment, the controller 604 increases the current provided to the lamp L2 for a predetermined period of time when the lamp impedance L2 is unstable by adjusting a frequency of the AC signal provided by the inverter VAC1 to a predetermined frequency. The predetermined frequency corresponds to a rated current of the lamp L2. The controller 604 also adjusts the frequency of the AC signal provided by the inverter VAC1 to a frequency corresponding to a current associated with the selected dimming level after the predetermined period of time (i.e., attempts to decrease the current to the selected dimming level again following the warm-up time).

Figure 10:
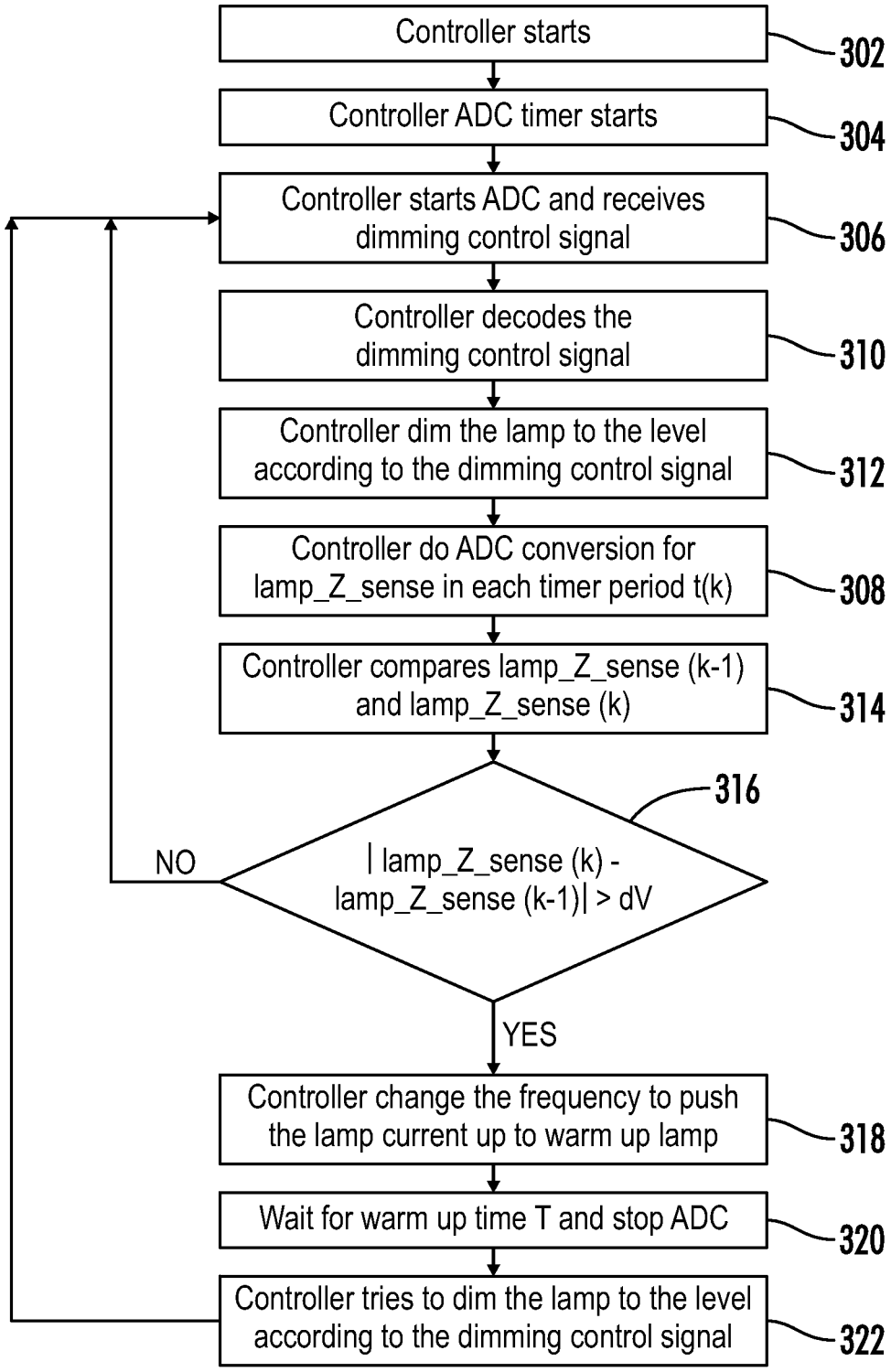
FIG. 10 is a flowchart of a method of providing stable current to a lamp from a power source via a ballast while decreasing lamp light output to a selected dimming level in accordance with an embodiment of the present invention.

Referring to FIG. 10, a method of providing stable current to the lamp L2 from a power source via the ballast 902 while decreasing lamp light output to a selected dimming level begins at step 302 with starting or initializing the controller 604. A timer of an analog to digital converter (ADC) in the controller 604 starts at 304. At 306, the controller 604 starts the ADC and receives the dimming control signal from the dimming controller. At 310, the controller 604 decodes the dimming control signal. At 312, the controller 604 dims the lamp L2 to the selected dimming level indicated by the received dimming control signal. At 308, the ADC of the controller 604 senses the lamp impedance L2 via the impedance sensing circuit (606 or 904) by converting Lamp_Z_sense (i.e., the impedance signal) in each timer period t(k). At 314, the controller 604 calculates a change in the lamp impedance L2 over time by comparing the lamp impedance of the present timer period to the lamp impedance of a previous timer period (i.e., Lamp_Z_sense(k−1) to Lamp_Z_sense(k)). At 316, the controller 604 determines whether the lamp impedance is unstable by determining whether the change in the lamp impedance over time exceeds a predetermined threshold. If the lamp impedance is not unstable, then the controller 604 returns to step 306 and again starts the timer of the ADC to sample the lamp impedance (Lamp_Z_sense).

If the lamp impedance is unstable, the controller 604 increases the current provided to the lamp (i.e., current through the lamp) for a predetermined period of time by adjusting the frequency of the AC signal provided by the inverter VAC1 of the ballast 902. Increasing the current provided the lamp begins at 318 when the controller 604 changes the frequency of the inverter VAC1 to increase the lamp current and warm-up the lamp L2. At 320, the controller 604 continues operating the inverter VAC1 at the altar frequency to maintain the increased lamp current and temporarily stops operation of the ADC timer for the predetermined period of time (i.e., the warm-up time). The controller 604 then proceeds to 322 tries to dim the lamp L2 to the selected dimming level according to the dimming control signal and proceeds back to 306. In one embodiment, the controller 604 changes the frequency of the AC signal provided by the inverter VAC1 to a predetermined frequency corresponding to a rated current of the lamp L2.

Although described in connection with a single lamp for simplicity, embodiments of the invention may be implemented in ballasts driving any number of lamps.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, circuits, and controllers described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, computing device, or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as hard coding, computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful Adaptive Lamp Warm Up Control for Dimming Ballast Based on Lamp Impedance Sensing it is not intended that such references be construed as limitations upon the scope of this invention except as set forth in the following claims.

What is claimed is:

1. An electronic ballast comprising:

an inverter functional to receive power from a power source and provide an alternating current (AC) signal at an inverter frequency;

first and second output ballast output terminals;

a resonant tank coupled to the inverter and configured to receive the AC signal from the inverter and provide an output signal across the first and second ballast output terminals;

an impedance sensing circuit comprising a direct current (DC) power supply operable to provide a DC voltage referenced to a ballast ground, a first resistor connected between the DC power supply and the first ballast output terminal, a second resistor having a first terminal connected to the first ballast output terminal and a second terminal, a third resistor connected between the ballast ground and the second terminal of the second resistor; and a controller connected to the inverter and the second terminal of the second resistor, wherein the controller is effective to sense a lamp impedance of a lamp coupled to the ballast output terminals by detecting a DC voltage impedance signal provided at the second terminal of the second resistor, calculate a change in the lamp impedance over time, determine whether the lamp impedance is unstable by determining whether the change in the lamp impedance over time exceeds a predetermined threshold, and increase a current provided to the lamp by the ballast for a predetermined period of time when the lamp impedance is unstable by adjusting the inverter frequency.

2. The ballast of claim 1, wherein the impedance sensing circuit further comprises:

an output capacitor connected between the second ballast output terminal and the ballast ground; and an output resistor connected in parallel with the output capacitor.

3. The ballast of claim 1, wherein the impedance sensing circuit further comprises:

a smoothing capacitor connected in parallel with the third resistor.

4. The ballast of claim 1, wherein the resonant tank is a series resonant tank comprising:

a resonant inductor having a first terminal and a second terminal, the first terminal connected to an output of the inverter to receive the AC signal provided by the inverter; and a resonant capacitor connected between the second terminal of the resonant inductor and the ballast ground.

5. The ballast of claim 1, wherein the resonant tank is a series resonant tank comprising:

a resonant inductor having a first terminal and a second terminal, the first terminal connected to an output of the inverter to receive the AC signal provided by the inverter;

a resonant capacitor connected between the second terminal of the resonant inductor and the ballast ground; and a first DC blocking capacitor connected between the first ballast output terminal and the second terminal of the resonant inductor.

6. The ballast of claim 1, wherein the inverter is a half bridge inverter.

7. The ballast of claim 1, further comprising a filament heating circuit comprising:

a filament circuit inverter having an output;

a second DC blocking capacitor;

a transformer comprising a primary winding, wherein the primary winding and the second DC blocking capacitor are connected in series between the output of the filament circuit inverter and the ballast ground, a first secondary winding connected between the series resonant tank and the first ballast output terminal; and a second secondary winding connected between the second ballast output terminal and the ballast ground.

8. The ballast of claim 1, wherein the power source is an AC power source and the ballast further comprises a DC to DC power converter connected between the power source and the inverter.

9. The ballast of claim 1, wherein:

the controller is functional to increase the current provided to the lamp for a predetermined period of time when the lamp impedance is unstable by adjusting the inverter frequency to a predetermined inverter frequency corresponding to a rated current of the lamp; and the controller is further functional to adjust the inverter frequency to a dimming frequency corresponding to a current associated with the selected dimming level after the predetermined period of time.

10. A light fixture comprising:

a ballast having first and second ballast output terminals;

a lamp connected between the first and second ballast output terminals;

the ballast further comprising an inverter operable to receive power from the power source and provide an alternating current (AC) signal at an inverter frequency, a resonant tank coupled to the inverter and configured to receive the AC signal from the inverter and provide a ballast output signal across the first and second ballast output terminals, an impedance sensing circuit comprising a direct current (DC) power supply operable to provide a DC voltage referenced to a ballast ground, a first resistor connected between the DC power supply and the first ballast output terminal, a second resistor having a first terminal and a second terminal, wherein the first terminal of the second resistor is connected to the first ballast output terminal, and a third resistor connected between the ballast ground and the second terminal of the second resistor; and a controller connected to the inverter and the second terminal of the second resistor operable to:

sense the lamp impedance via the impedance signal provided at the second terminal of the second resistor;

calculate a change in the lamp impedance over time;

determine whether the lamp impedance is unstable by determining whether the change in the lamp impedance over time exceeds a predetermined threshold; and increase the current provided to the lamp for a predetermined period of time when the lamp impedance is unstable by adjusting a frequency of the AC signal provided by the inverter; and a housing connected to the lamp and the ballast.

11. The light fixture of claim 10, wherein the impedance sensing circuit further comprises:

an output capacitor connected between the second ballast output terminal and the ballast ground; and an output resistor in parallel with the output capacitor.

12. The light fixture of claim 10, wherein the impedance sensing circuit further comprises:

a smoothing capacitor connected in parallel with the third resistor.

13. The light fixture of claim 10, wherein the resonant tank is a series resonant tank comprising:

a resonant inductor having a first terminal and a second terminal, wherein the first terminal of the resonant inductor is connected to an output of the inverter to receive the AC signal provided by the inverter; and a resonant capacitor connected between the second terminal of the resonant inductor and the ballast ground.

14. The light fixture of claim 10, wherein the resonant tank is a series resonant tank comprising:

a resonant inductor having a first terminal and a second terminal, wherein the first terminal of the resonant inductor is connected to an output of the inverter to receive the AC signal provided by the inverter;

a resonant capacitor connected between the second terminal of the resonant inductor and the ballast ground; and a first DC blocking capacitor connected between the first ballast output terminal and the second terminal of the resonant inductor.

15. The light fixture of claim 10, wherein the inverter is a half bridge inverter.

16. The light fixture of claim 10, wherein the ballast further comprises a filament heating circuit operable to heat filaments of the lamp, said filament heating circuit comprising:

a filament circuit inverter having an output;

a second DC blocking capacitor;

a transformer comprising:

a primary winding, wherein the primary winding and the second DC blocking capacitor are connected in series between the output of the filament circuit inverter and the ballast ground;

a first secondary winding connected between the series resonant tank and the first ballast output terminal; and a second secondary winding connected between the second ballast output terminal and the ballast ground.

17. The light fixture of claim 10, wherein the power source is an AC power source and the ballast further comprises a DC to DC power converter connected between the power source and the inverter.

18. The light fixture of claim 10, wherein:

the controller increases the current provided to the lamp for a predetermined period of time when the lamp impedance is unstable by adjusting a frequency of the AC signal provided by the inverter to a predetermined frequency, wherein the predetermined frequency corresponds to a rated current of the lamp; and the controller is further operable to adjust the frequency of the AC signal provided by the inverter to a frequency corresponding to a current associated with the selected dimming level after the predetermined period of time.

* * * * *